US011062862B2

(12) United States Patent
Galletti et al.

(10) Patent No.: US 11,062,862 B2
(45) Date of Patent: Jul. 13, 2021

(54) GAS-INSULATED HIGH OR MEDIUM VOLTAGE CIRCUIT BREAKER

(71) Applicant: ABB Power Grids Switzerland AG, Baden (CH)

(72) Inventors: Bernardo Galletti, Nussbaumen (CH); Valeria Teppati, Otelfingen (CH); Emmanouil Panousis, Baden (CH); Angelos Garyfallos, Nierderrohrdorf (CH); Branimir Radisavljevic, Zürich (CH); Joerg Lehmann, Basel (CH); Christoph Reutlinger, Bern (CH); Daniel Over, Klingnau (CH); Patrick Stoller, Fällanden (CH)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/772,606

(22) PCT Filed: Dec. 21, 2018

(86) PCT No.: PCT/EP2018/086633

§ 371 (c)(1),
(2) Date: Jun. 12, 2020

(87) PCT Pub. No.: WO2019/122352

PCT Pub. Date: Jun. 27, 2019

(65) Prior Publication Data

US 2020/0395180 A1 Dec. 17, 2020

(30) Foreign Application Priority Data

Dec. 22, 2017 (EP) ..... 17210547

(51) Int. Cl.
*H01H 1/38* (2006.01)
*H01H 33/70* (2006.01)
(Continued)

(52) U.S. Cl.
CPC ..... *H01H 33/7084* (2013.01); *H01H 1/385* (2013.01); *H01H 33/7023* (2013.01); *H01H 33/95* (2013.01); *H01H 2033/906* (2013.01)

(58) Field of Classification Search
CPC ..... H01H 33/7084; H01H 33/7023; H01H 33/7038; H01H 33/74; H01H 33/78;
(Continued)

(56) References Cited

U.S. PATENT DOCUMENTS 4,471,187 A 9/1984 Sturzenegger et al.
5,153,397 A * 10/1992 Seki ..... H01H 33/91 218/62

(Continued)

OTHER PUBLICATIONS

International Search Report and Written Opinion of the International Searching Authority, PCT/EP2018/086633, dated Mar. 8, 2019, 10 pages.

(Continued)

*Primary Examiner* — William A Bolton
(74) *Attorney, Agent, or Firm* — Sage Patent Group

(57) ABSTRACT

The present disclosure provides a gas-insulated high or medium voltage circuit breaker including a first arcing contact and a second arcing contact, wherein at least one of the two arcing contacts is axially movable including a first and a second state of motion along a switching axis, wherein during a breaking operation, an arc between the first arcing contact and the second arcing contact is formed in an arcing region; a nozzle including a channel directed to the arcing region, for blowing an arc-extinguishing gas to the arcing region during the breaking operation; a diffuser adjacent to the nozzle, for transporting the gas from the arcing region to a region downstream of the diffuser; a buffer volume directly downstream of the diffuser, and an enclosure substantially surrounding the buffer volume circumferentially.

16 Claims, 2 Drawing Sheets

(51) Int. Cl.
*H01H 33/90* (2006.01)
*H01H 33/95* (2006.01)

(58) Field of Classification Search
CPC .. H01H 33/95; H01H 33/91; H01H 2033/906; H01H 1/385
USPC .... 218/1, 13, 14, 51, 52, 53, 56, 57, 59, 60, 218/61, 63
See application file for complete search history.

(56) References Cited

U.S. PATENT DOCUMENTS 5,898,149 A * 4/1999 Berger ..... H01H 33/904 218/60
7,732,727 B2 * 6/2010 Saxl ..... H01H 33/70 218/51
8,546,716 B2 * 10/2013 Nufer ..... H01H 33/901 218/43
9,058,947 B2 * 6/2015 Yaginuma ..... H01H 33/901
2011/0163069 A1 * 7/2011 Ohlsson ..... H01H 33/901 218/66
2014/0190938 A1 7/2014 Tsukushi
2014/0209568 A1 7/2014 Cernat et al.
2014/0251957 A1 9/2014 Cernat et al.
2018/0226214 A1 * 8/2018 Kotsuji ..... H01H 33/56

OTHER PUBLICATIONS

International Search Report and Written Opinion of the International Searching Authority, PCT/EP2018/086636, dated Mar. 6, 2019, 9 pages.
Search Report and Opinion of the European Patent Office, EP 17210547.0, dated Jun. 27, 2018, 4 pages.
Search Report and Opinion of the European Patent Office, EP 17210549.6, dated Jun. 18, 2018, 7 pages.
International Preliminary Examination Report, PCT/EP2018/086633, dated Jun. 23, 2020, 8 pages.
International Preliminary Examination Report, PCT/EP2018/086636, dated Jun. 23, 2020, 7 pages.

* cited by examiner

GAS-INSULATED HIGH OR MEDIUM VOLTAGE CIRCUIT BREAKER

CROSS REFERENCE TO RELATED APPLICATIONS

This application is a 35 U.S.C. § 371 national stage application of PCT International Application No. PCT/EP2018/086633 filed on Dec. 21, 2018, which in turns claims foreign priority to European Patent Application No. 17210547.0, filed on Dec. 22, 2017, the disclosures and content of which are incorporated by reference herein in their entirety.

FIELD

Embodiments of the present disclosure relate generally to a gas-insulated circuit breaker for breaking high or medium voltages, and in particular to a circuit breaker with increased resilience against arc re-ignition.

BACKGROUND

Circuit breakers are well known in the field of medium and high voltage breaking applications. They are predominantly used for interrupting a current, when an electrical fault occurs. As an example, circuit breakers have the task of opening contacts and keeping them apart from one another in order to avoid a current flow even in case of high electrical potential originating from the electrical fault itself. The circuit breaker, may break medium to high short circuit currents of 1 kA to 80 kA at medium to high voltages of 12 kV to 72 kV and up to 1200 kV. The operation principle of circuit breakers is known.

Such circuit breakers are arranged in the respective electrical circuits which are intended to be interrupted based on some predefined event occurring in the electrical circuit. Generally, operation of such circuit breakers are responsive to detection of a fault condition or fault current. On detection of such a fault condition or fault current, a mechanism may operate the circuit breaker so as to interrupt the current flowing there through, thereby interrupting the current flowing in the electrical circuit. Once a fault is detected, contacts within the circuit breaker separate in order to interrupt the electrical circuit. Often spring arrangements, pneumatic arrangements or some other means utilizing mechanically stored energy are employed to separate the contacts. Some of the energy required for separating the contacts may be obtained from the fault current itself. When interrupting the current flowing in the electrical circuit, an arc is generally generated. This arc must be cooled so that it becomes quenched or extinguished, such that the gap between the contacts repeatedly can withstand the voltage in the electrical circuit. It is known to use, air, oil or insulating gas as medium in which the arc forms. Insulating gas comprises for example Sulphur hexafluoride (SF6) or $CO_2$.

However, after the arc has been extinguished a late restrike may occur. In particular, gas that is ejected downstream from the nozzle during the arcing phase may not diffuse entirely to volumes leading to the external insulator. In such a case, a late restrike may occur if heated gas flows back to the gap between the contacts, e.g. the arcing zone or arcing region. For example, in the case of a long arcing time in the duties with large values of short circuit values, e.g. values around 31 kA or 40 kA, the hot gas may remain trapped relatively close to the arcing zone and can expand back towards it after a current zero event, when the outflow of gas, for example through a compression volume and a heating volume, has stopped. Due to the increased temperature of the heated gas, the gas can have decreased dielectric strength, which would decrease the insulating properties of the gas. If the dielectric strength of the gas is decreased in the arcing zone, the arc can reignite.

The phenomenon or the flow reversal of hot gas back to the arcing region can have its largest magnitude in the case of long arcing times. The reason can be that in a long arcing time (symmetrical) shot, an extra back-heating cycle can take place due to the partial half wave of the current. The heating volume is then emptied when the current crosses the second-to-last zero. As a consequence, the gas present in the heating volume at the beginning of the last back-heating process can be less dense than it would be in the case of a shot with only one back-heating cycle. Therefore, under the same energy input conditions, the gas is heated up to higher temperatures making the event of a late restrike more likely.

While increasing the heating or compression volume and/or possibly even the drive energy might help to reduce the risk of late restrikes, these measures could be either difficult to implement and/or could also increase the costs and may be too expensive.

Thus, there is a need for alternative means for reducing the risk of late restrikes. In particular, there is a need for addressing late restrikes in a low-cost way and/or in a way that is easy to implement.

In particular, there is a need to improve the dielectric withstand of gas-insulated high or medium voltage circuit breaker, such as gas-insulated high-voltage current breakers. Further, there is a need to decrease the tendency of heated gas to flow back to the arcing zone.

Further, it would be beneficial to achieve a reduction of the temperature of the gas downstream of the arcing zone, so that gas that may flow back to the arcing zone has a lower temperature.

SUMMARY OF THE INVENTION

An object of the invention is to provide an improved gas-insulated high or medium voltage circuit breaker for reliable arc extinction while still maintaining at least to some extent a relatively low-cost design.

In light of the above, a gas-insulated high or medium voltage circuit breaker is provided. Further, a method of operating a gas-insulated high or medium voltage circuit breaker is provided. Aspects, benefits, and features of the present disclosure are apparent from the claims, the description, and the accompanying drawings.

According to one aspect, gas-insulated high or medium voltage circuit breaker is provided. The gas-insulated high or medium voltage circuit breaker includes a first arcing contact and a second arcing contact, wherein at least one of the two arcing contacts is axially movable including a first and a second state of motion along a switching axis. During a breaking operation, an arc between the first arcing contact and the second arcing contact is formed in an arcing region. The gas-insulated high or medium voltage circuit breaker further includes a nozzle including a channel directed to the arcing region, for blowing an arc-extinguishing gas to the arcing region during the breaking operation. The gas-insulated high or medium voltage circuit breaker further includes a diffuser adjacent to the nozzle, for transporting the gas from the arcing region to a region downstream of the diffuser, and a buffer volume directly downstream of the diffuser. The gas-insulated high or medium voltage circuit breaker further includes an enclosure substantially surrounding the buffer volume circumferentially. The enclosure includes an inner enclosure portion and a coaxially arranged outer enclosure portion. At least one of the inner portion and the outer portion is movable relative to the other one. A first aperture is provided on a surface of the inner enclosure portion and a second aperture is provided on a surface of the outer enclosure portion, such that a through opening is provided through the enclosure. In the first state of motion during a breaking operation the through opening is blocked, as to prevent the gas from being released from the buffer volume to a volume outside of the enclosure. In the second state of motion, the first aperture and the second aperture overlap, such that the overlap of the first aperture and the second aperture provides the through opening for the gas to be partially released from the buffer volume to the volume outside of the enclosure.

According to a further aspect, a method of operation a gas-insulated high or medium voltage breaker is provided. The method includes breaking an electric current with the gas-insulated high or medium voltage circuit breaker according to aspects and embodiments described herein.

BRIEF DESCRIPTION OF THE DRAWINGS

For a more detailed understanding of the above recited features of the present disclosure, a more particular disclosure is given which makes reference to embodiments and accompanying drawings.

DETAILED DESCRIPTION OF EMBODIMENTS

Figure 1:
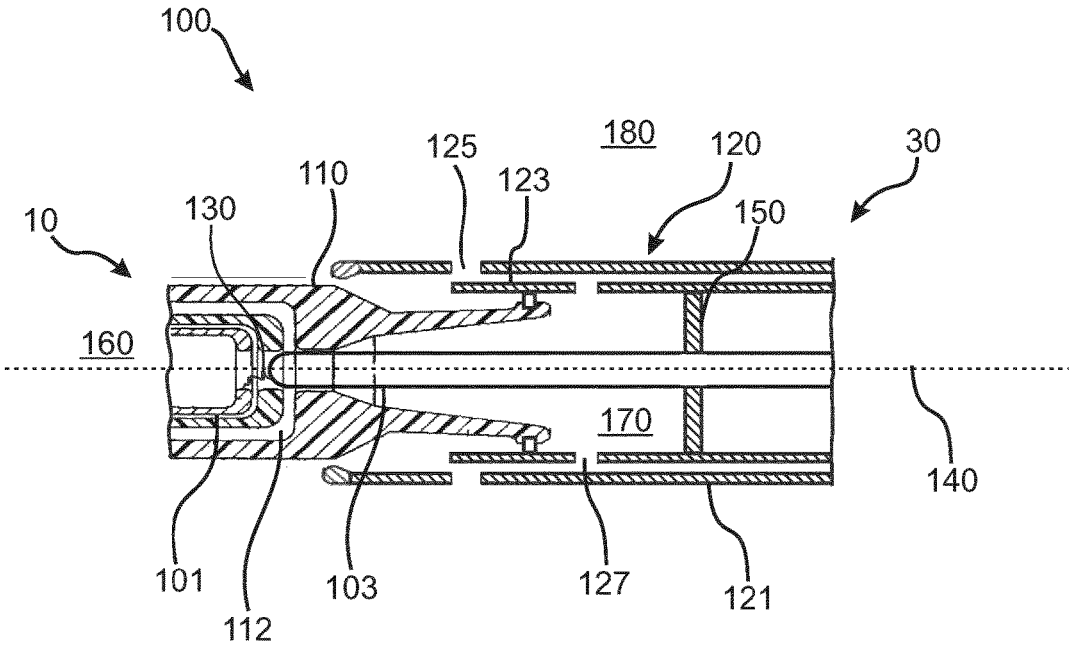
FIGS. 1 and 2 schematically show a gas-insulated high or medium circuit breaker according to a first embodiment described herein.

Reference will now be made in detail to the various embodiments of the disclosure, one or more examples of which are illustrated in the figures. Within the following description of the drawings, the same reference numbers refer to same components. Generally, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

Although the following description is given with respect to a gas-insulted circuit breaker, and particularly with respect to a gas-insulated high or medium voltage circuit breaker for medium and high voltage applications, it is to be understood that the embodiments of the present disclosure are not limited thereto. Instead, the present embodiments could be applied anywhere where a gas-insulated circuit breaker is needed.

For simplicity, embodiments described herein often refer to a circuit breaker, instead of referring to a gas-insulated high or medium circuit breaker. The circuit breaker may be a puffer type circuit breaker, a self-blast circuit breaker, a generator circuit breaker, a disconnector, a combined disconnector and circuit breaker, a live tank breaker, or a load break switch in power transmission and distribution systems.

The term high or medium voltage relates to voltages that exceeds 1 kV. A medium voltage preferably concerns nominal voltages in the range from 12 kV to 72 kV (medium voltage range), like 25 kV, 40 kV or 60 kV. A high voltage preferably relates to nominal voltages in the range from above 72 kV to 550 kV, like 145 kV, 245 kV or 420 kV. Nominal currents of the circuit breaker can be preferably in the range from 1 kA to 5 kA. The current which flows during the abnormal conditions in which the circuit breaker performs its duty may be interchangeably referred to as the breaking current or the short circuit current. The short circuit current may be in the range from 31.5 kA to 80 kA, which is termed high short-circuit current duty. In low short-circuit current duties, the breaking current is typically larger than the nominal current and smaller than 0.3 times the rated short-circuit current, e.g., at most 24 kA. During a breaking operation, breaking voltages may be very high, e.g., in the range from 110 kV to 1200 kV.

The term "axial" designates an extension, distance etc. in the direction of the axis. An axial separation between parts means that these parts are separated from each other when seen or measured in the direction of the axis. The term "radial" designates an extension, distance etc. in a direction perpendicular to the axis. The term "cross-section" means a plane perpendicular to the axis, and the term "cross-sectional area" means an area in such a plane. The axis can be, for example, the switching axis.

A circuit breaker can include a nominal contact or nominal current path. As used herein, an electrical contact through which the nominal current passes, i.e. a nominal current path, is called a nominal contact, and the combination of the nominal contact and an arcing contact is called henceforth "breaker contact". As used herein, at least one of the breaking contacts relatively moves with respect to the other breaker contact. That is to say, at least one of the breaker contacts is moving.

In a gas-insulated circuit breaker, the arc-extinguishing medium comprises a gas. In embodiments, the circuit breaker can include an encapsulating housing which defines a volume for the gas. According to some embodiments, the circuit breaker can include a gas blowing system configured to extinguish an arc formed between a first arcing contact and a second arcing contact of the circuit breaker during a stage of the current interruption operation.

The circuit breaker contacts are typically adapted for electrically interconnecting the circuit breaker to the electrical circuit to be protected. According to embodiments herein, a medium voltage is a voltage of at least about 12 kV or higher up to and including 72 kV. A high voltage as used herein relates to nominal voltage of higher than 72 kV. According to some embodiments, the high voltage can be a voltage of at least about 123 kV or at least 145 kV or higher.

The circuit breaker may include one or more components such as, a puffer-type cylinder, a self-blast chamber, a pressure collecting space, a compression space, or puffer volume, and an expansion space. The circuit breaker may effectuate interruption of the electrical circuit by means of one or more of such components, thereby discontinuing flow of electrical current in the electrical circuit, and/or extinction of the arc produced when the electrical circuit is interrupted.

The circuit breaker can include also other parts such as a drive, a controller, and the like, which have been omitted in the Figures. These parts are provided in analogy to a conventional high or medium voltage gas-insulated circuit breaker.

Figure 2:
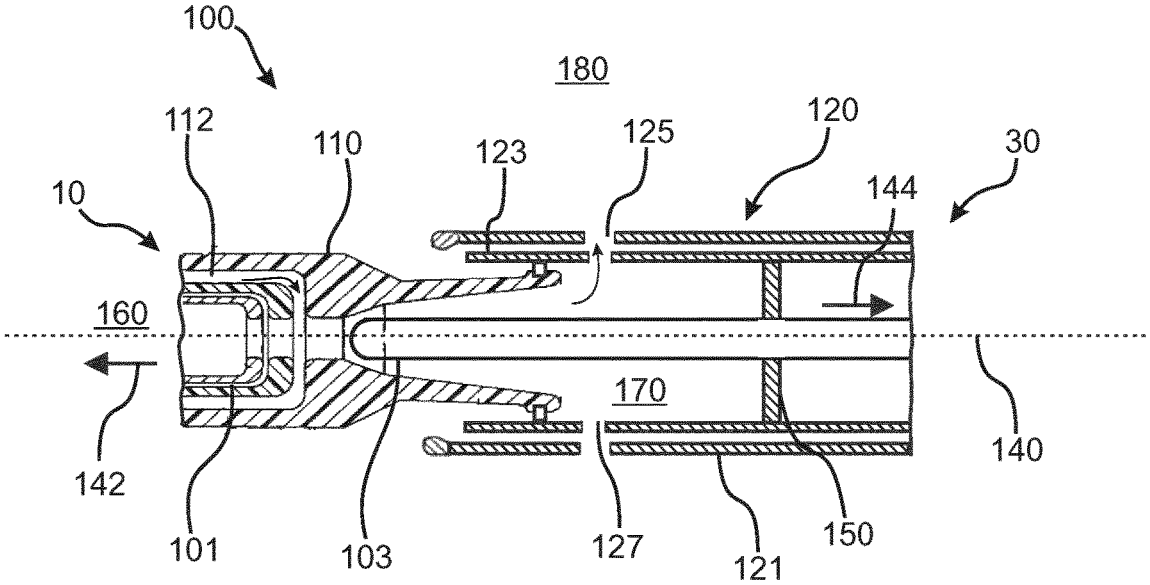

A gas-insulated circuit breaker 100 according to embodiments described herein, for high or medium voltages, is shown in FIG. 1 and FIG. 2. The circuit breaker 100 includes a first arcing contact 101 and a second arcing contact 103. The first arcing contact 101 may be illustrated in FIG. 1 in the form of a tulip, e.g. a contact tulip. As shown in FIG. 1 the second arcing contact 103 is in the form of a rod, e.g. a contact rod. The two arcing contacts 101 and 103 co-operate with each other between an open end-position, in which the two arcing contacts 101 and 103 are completely electrically separated from each other, and a closed end-position, in which an electric current can pass between them.

The first acing contact 101 can for example be part of a first breaking contact 10 having a first nominal contact, which is for simplicity not illustrated in FIG. 1 and FIG. 2. Further, the second arcing contact 102 can be part of a second breaking contact 30 with a second nominal contact.

The first and the second arcing contacts 101, 103 are constituted in a manner such that they can conveniently carry an interruption current, so that the arcing contacts do not generate excessive heating and withstand the heat of an arc generated during a current interruption operation of the circuit breaker 100. In particular, arcing contacts 101 and 103 are made of any suitable material, typically arc-resistant material, that enables the circuit breaker 100 to function as described herein, such as exemplarily, but not limited to: copper, copper alloys, silver alloys, tungsten, tungsten alloys, or any combination(s) thereof. In particular, these materials are chosen on the basis of their electrical conductivity, hardness (i.e. resistance to abrasive wear), mechanical strength, low cost, and/or chemical properties. For example, the contact rod shown in FIGS. 1 and 2 and forming the second arcing contact 103 is made of any suitable conductive material which enables the circuit breaker 100 to function as described herein, such as exemplarily, but not limited to, copper. If required, the contact rod may be made of different materials, for example, different parts thereof may be made of different materials or be coated with a material which provides adequate electrical and/or mechanical properties to each of these parts.

As indicated by the arrows 142, 144 in FIG. 2, at least one of the first and the second arcing contact 101, 103, e.g. as part of the first breaking contact 10 and the second breaking contact 30, is movable relatively to the other one along a switching axis 140 to bring the arcing contacts in the open end-position or in the closed end-position.

In the closed end-position, the second arcing contact 103 is inserted into the first arcing contact 101. During the breaking operation, the first arcing contact 101 moves away from the second arcing contact 103 so that both contacts separate from one another. During the breaking operation, as shown in FIG. 1, an arc develops in the arcing region between portions of the first and second arcing contact 101, 103.

The circuit breaker 100 shown in FIGS. 1 and 2 is arranged in a gas-tight housing filled with an electrically insulating gas or arc-extinguishing gas. The volume between the housing and the components of the circuit breaker 100 shown in FIGS. 1 and 2 is indicated by reference numeral 180. This will be also referred to as an "outer volume" 180, which is a volume inside the gas-tight housing. The gas-tight housing can be constituted as an encapsulation, such as, but not limited to, a metallic or ceramic housing. Such encapsulation can be mounted on a suitable structure.

According to embodiments of the present disclosure, which can be combined with embodiments described herein, the circuit breaker can include a gear system operatively coupled to at least one of the first or second arcing contact and the nozzle for providing a translation along the switching axis. In embodiments, at least a portion of the gear system is arranged at a supporting structure. In some embodiments, the circuit breaker is a single motion circuit breaker. That is to say, only one of the first and second arcing contact is movable along the switching axis. In other embodiments, the circuit is a double motion circuit breaker. In other words, both of the first and the second arcing contact are movable along the switching axis.

As exemplarily shown in FIGS. 1 and 2, a plate-like structure 150 is formed as the supporting structure. The plate-like structure 150 can be, for example, a cylindrical plate arranged between the rod of the second arcing contact 103 and the inner enclosure portion 123. The plate-like structure 150 may guide the second arcing contact 103 during a breaking operation. Accordingly, in this case, the plate-like structure 150 would be provided slideably on the second arcing contact 103. Alternatively, the plate-like structure 150 may be moved together with the second arcing contact 103. For example, the plate-like structure 150 may be formed integrally with the second arcing contact 103.

The circuit breaker 100 further includes a nozzle 110 having a channel 112 directed to the arcing region. In other words, the channel 112 is directed to the arc. The nozzle 110 serves as a blowhole for blowing the arc-extinguishing gas to the arcing region during the breaking operation. Thereby, the arc can be extinguished or quenched.

The nozzle 110 includes a diffuser. In embodiments, the arc-extinguishing gas for blowing out the arc is provided in a volume upstream 160 of the diffuser. For example, the volume upstream 160 of the diffuser can be filled with a dielectric gas, such as in embodiments $CO_2$, $SF_6$ or $SF_6$ and its known mixtures, such as $N_2$ or $CF_4$. In further embodiments, also other insulating or arc-extinguishing gases are possible, as described below.

The diffuser may be adjacent, in the axial direction to the nozzle 110. The cross-sectional area of the diffuser may increase in the axial direction away from the nozzle. The diffuser may form a diverging duct for the flow of the arc-extinguishing gas. Accordingly, the arc-extinguishing gas from the volume upstream 160 of the diffuser is transported from the arcing region to a region downstream of the diffuser.

The region downstream of the diffuser includes a buffer volume 170 provided directly downstream of the diffuser. Accordingly, after the arc-extinguishing gas has passed through the arcing region and the diffuser, the arc-extinguishing gas reaches the buffer volume 170. The buffer volume 170 is substantially surrounded by an enclosure 120 circumferentially. That is to say, the enclosure 120 can substantially delimit the radial extent of the buffer volume 17. The term "buffer volume directly downstream of the diffuser" as used herein can be understood as in direct fluid communication with the arcing region.

The enclosure 120 includes an inner enclosure portion 123 and an outer enclosure portion 121. The outer enclosure portion 121 is coaxially arranged with respect to the inner enclosure portion 123. As shown in FIG. 1 and FIG. 2, the outer enclosure portion 121 is movable relatively to the inner enclosure portion along the switching axis 140.

In embodiments of the present disclosure, at least one of the inner and the outer enclosure portion 123, 121 is movable relatively to the other one. For example, the inner enclosure portion 123 could be provided fixedly to the plate-like structure 150, whereas the outer enclosure portion 121 is provided axially movable with respect to the inner enclosure portion 123 and the plate-like structure 150. In other embodiments, the inner enclosure portion 123 can be provided slideably along the plate-like structure 150. Thereby, the inner enclosure portion 123 can be made movable with respect to the outer enclosure portion 121 along the switching axis 140. In further embodiments, both the inner and the outer enclosure portion 123, 121 can be provided to be movable.

A first aperture 127 is provided on a surface of the inner enclosure portion 123. A second aperture 125 is provided on a surface of the outer enclosure portion 121. The first and the second aperture 125, 127 can be for example implemented as one or more holes, perforations, ducts, or one or more slits, or the like. One or more apertures can for example be provided along a circumference of the inner enclosure portion 123. If more than one aperture 127 is provided on the inner enclosure portion 123, e.g. by providing a plurality of apertures 127 along a circumference of the respective enclosure portion, then all apertures of the respective enclosure portion may lie substantially in the same cross-sectional plane of the inner enclosure portion 123. Similarly, one or more apertures 125 can be provided along a circumference of the outer enclosure portion 121.

In FIG. 2, the inner and the outer enclosure 123, 121 are in a second state of motion during a breaking operation. The first and the second arcing contact 101, 103 are separated. The second state of motion can be a state in which the arc (FIG. 1) has been extinguished or is about to be extinguished, e.g. at a current zero event (CZ) or a current zero crossing of the current. Due to the arc, the temperature of the arc-extinguishing gas has increased in the arcing zone and the buffer volume 180, as compared to the initial temperature of the gas provided in the volume provided upstream 160.

As shown in FIG. 2, the first aperture 127 and the second aperture 125 overlap in the second state of motion and thereby provide a through opening, through which the gas can be partially released from the buffer volume 170. That is to say, only a part of the gas may be released through the through opening, while another part remains in the buffer volume 170. The gas flow path is indicated in FIG. 2 by arrows having no reference signs. A part of the arc-extinguishing gas can be then released to the outer volume 180.

In FIG. 1 the through opening (shown in FIG. 2) is blocked, thereby preventing the gas from being released through the first aperture 127 and the second aperture 125. Accordingly in a first state of motion (shown in FIG. 1), the through opening of the enclosure is blocked. Accordingly, the through opening can be closed or opened by moving at least one of the inner and the outer enclosure portion 123, 121 relatively to other one. In some embodiments, the through opening remains open after CZ for a suitable time, such that a suitable portion of the heated gas can be released. The arc-extinguishing gas that remains in the buffer volume 170 can escape the buffer region 170 through an exhaust provided downstream at an end of the circuit breaker.

In embodiments of the present disclosure, one of the inner enclosure portion 123 and the outer enclosure portion 121 can be stationary and the respective other one can be movable together with the second arcing contact.

According to embodiments of the present disclosure, which can be combined with embodiments described herein, the inner enclosure portion 123 and the outer enclosure portion 121 of the enclosure 120 can be provided in a cylindrical shaped. In embodiments, the inner and the outer enclosure portion 123, 121 can be formed as a portion of a nominal current path. In this embodiment, the inner and the outer enclosure portion 123, 121 can be easily integrated into a known design.

As the arc-extinguishing gas gets heated by the arc during the arc quenching process, a part of the heated gas that flows from the arcing zone to the buffer volume 170 can be released to the outer volume 180. By this, the temperature of the arc-extinguishing gas in the buffer volume 170 can be decreased. Accordingly, also the probability or risk of a restrike or late restrike, i.e. a reignition of the arc, due to a flow reversal of heated gas from the buffer volume 170 back to the arcing zone can be decreased. In other words, when the volume upstream 160 of the diffuser has been drained, the gas that moves through the second breaker contact 30 back towards the nozzle 110 is cooler and poses less of a threat with respect to a reignition of the arc.

In embodiments of the present disclosure, the through opening in the second state of motion is preferably established at a zero crossing of the current during an arcing time during the breaking operation. At a zero crossing of the current, the current can be interrupted.

In embodiments, the first state of motion can correspond to a start of the breaking operation. In the start of the breaking operation, i.e. the beginning of the arcing phase, the first arcing contact and the second arcing contact start to move apart along the switching axis. As described above, in the first state of motion the through opening in the enclosure is closed. Thus, in the beginning of the breaking operation or the arcing phase, the flow of gas to the buffer volume 170 can be faster and/or the gas can be denser, compared to a case in which the through opening would be already provided in an open position in the first state of motion.

According to embodiments of the present disclosure, which can be combined with embodiments described herein, in the second state of motion, the overlap of the first aperture 127 and the second aperture 125 can be formed at an axial position located along an length axis extending between a front portion of the diffuser and an axial end portion of the second arcing contact 103.

According to embodiments of the present disclosure, which can be combined with embodiments described herein, at least part of the enclosure is formed as a portion of a nominal current path. For example, at least one of the inner and the outer enclosure portion can be formed as a portion of a nominal contact, e.g. an upper current carrier, provided on the second breaker contact.

For example, the enclosure 120 shown in FIGS. 1 and 2 is formed as a portion of the nominal contact of the second breaker contact 30.

According to embodiments of the present disclosure, which can be combined with embodiments described herein, the inner enclosure portion and the outer enclosure portion of the enclosure can be electrically conductive metal pipes. In this embodiment, the enclosure would be an electrically conductive element having two electrically conductive metal pipes, which are coaxially arranged with respect to each other.

In embodiments of the present disclosure the enclosure can be on the electrical potential of the second arcing contact. In other words, the inner and the outer enclosure portion can be on the electrical potential of the second arcing contact. By this, electrical arcing between the second arcing contact and the enclosure can be avoided.

According to some embodiments of the present disclosure, which can be combined with embodiments described herein, an arc-extinguishing system for extinguishing the arc can be integrated in the volume upstream 160 of the nozzle. In embodiments, the arc-extinguishing system can have a pressurizing system (puffer system). The pressurizing system can for example include a pressurizing chamber (puffer chamber) having a quenching gas contained therein. The quenching gas is a portion of the insulation gas contained in the housing volume 180 (outer volume) of the circuit breaker 100. The pressurizing chamber is can be delimited by a chamber wall and a piston for compressing the quenching gas within the pressurizing chamber during the current breaking operation. To this purpose, the piston moves jointly with the first arcing contact 101 so that the piston pressurizes the quenching gas within the pressurizing chamber when the first arcing contact 101 is moved away from the second contact 103 for opening the circuit breaker.

In embodiments, the nozzle 110 is adapted for blowing the pressurized quenching gas, e.g. the arc-extinguishing gas, from the volume upstream 160 onto the arc formed during the current breaking operation. The nozzle can include an inlet connected to the pressurizing chamber for receiving the pressurized quenching gas from the pressurizing chamber, and a nozzle outlet to the arcing region. The nozzle 10 includes embodiments made of an electrically insulating material, as for example, PTFE. In some embodiments, the nozzle 110 can comprises a ring portion attached at one of its ends.

During the breaking operation i.e. the circuit-breaking process, the nominal contacts (not shown) are separated from each other and the first and second arcing contacts 101 and 103 then also separate from each other after a delay period, to form an electric arc that is extinguished by blowing the gas through the nozzle 110.

The electric arc is preferably extinguished during a zero crossing of the current by a flow of insulating gas which is blown away from the volume upstream of the diffuser, e.g. a heating volume of a self-blast circuit breaker or a compression volume of a puffer-type circuit breaker, towards the arcing region and to an exhaust volume.

According to some embodiments of the present disclosure, one of the inner enclosure portion and the outer enclosure portion is connected to a supporting structure provided at an end of the circuit breaker in the downstream direction. In some embodiments, the second arcing contact is formed as a plug-like rod. The plug-like rod may have at its end portion, in the downstream direction, a plate-like supporting structure. The plate-like supporting structure can be connected to the second arcing contact, e.g. the plug-like rod, or may be inherently formed with the second arcing contact. The supporting structure may be connected to the gear system. Accordingly, when a second breaker contact is formed as a movable breaking contact, the supporting structure and the second arcing contact can be moved together with one of the inner and the outer enclosure portion. Here, an additional drive connection of the inner and/or outer enclosure portion can be omitted. This could increase the compactness of the circuit breaker and can lead to reduced costs.

In some embodiments, it may be beneficial to guide the gas released from the buffer volume to the outer volume via the through opening to a certain direction. According to embodiments of the present disclosure, which can be combined with embodiments described herein, the circuit breaker can include a guiding element adjacent to the second aperture of the outer enclosure portion radially outside to guide the released gas in an axial direction away from the axial position of the arcing region.

Figure 3:
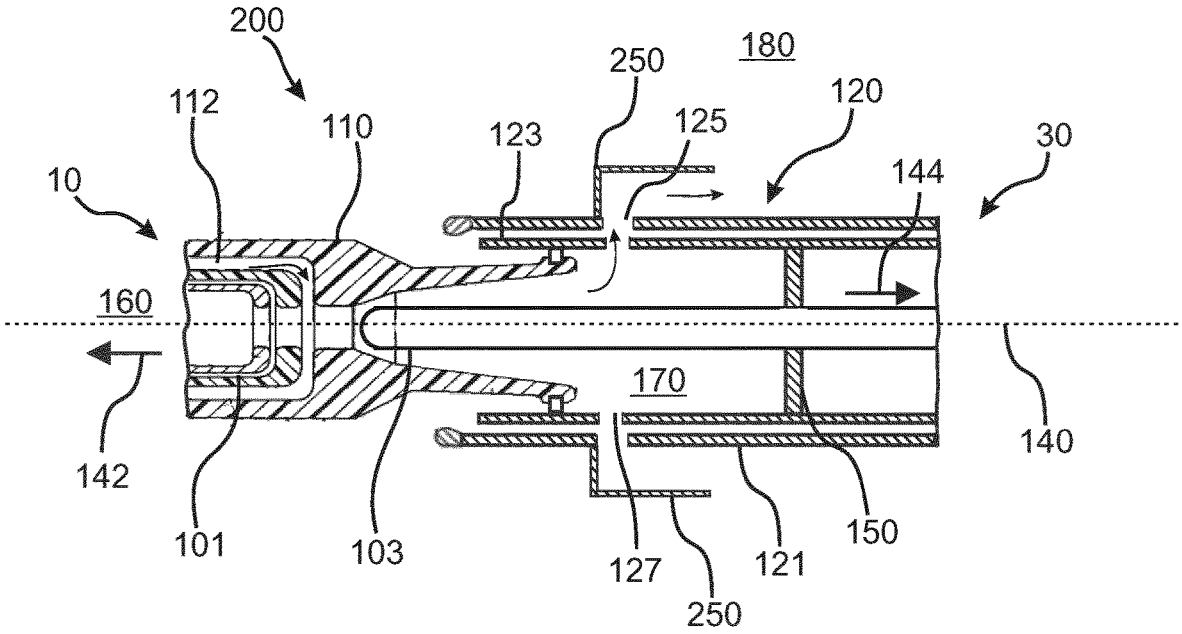
FIG. 3 schematically shows a gas-insulated high or medium circuit breaker according to a second embodiment described herein.

FIG. 3 shows a circuit breaker 200 having a guiding element 250 provided on the outer enclosure portion 121. The circuit breaker 200 of FIG. 3 is similar to the circuit breaker of FIGS. 1 and 2, and only the differences will be discussed in the following.

The guiding element 250 can guide the arc-extinguishing gas away from the arcing region as indicated by the arrows having no reference sign. Thereby, heated gas is substantially prevented from flowing back to the through opening of the enclosure 120 into the buffer volume 170. Furthermore, the heated gas can be prevented from entering the region of the nominal contacts. For example, the guiding element 250 can be integrated in the upper current carrier, e.g. in an enclosure 120 that is formed as the upper current carrier. In embodiments, the guiding element 250 can also be integrated in the outer shields, which protect the nominal contacts from heated gas released from the exhaust that is provided at an end portion of the circuit breaker. The guiding element 250 can be, for example, formed as a metal sheet. In embodiments, the guiding element can have the shape of an "L" in a cross sectional view of the circuit breaker, e.g. as for example shown in FIG. 3.

The present disclosure further relates to a method of operating a gas-insulated high or medium voltage circuit breaker. In particular, an electric current with a high or medium voltage circuit breaker according to embodiments described herein can be broken.

For breaking the electric current, the first arcing contact and the second arcing contact can be separated by moving at least one of the first and second arcing contact along the switching axis to initiate a breaking operation. Further, during the breaking operation, at least one of the inner enclosure portion and the outer enclosure portion can be moved relatively to each other along the switching axis, such that in the second state of motion the first aperture and the second aperture overlap and provide a through opening for the arc-extinguishing gas to be partially released from the buffer volume outside of the enclosure. By this, the temperature of the arc-extinguishing gas in the buffer volume can be decreased. Accordingly, also the probability or risk of a restrike or late restrike, i.e. a reignition of the arc, due to a flow reversal of heated gas from the buffer volume back to the arcing zone can be decreased.

In some embodiments, the through opening is established at a zero crossing of the current during an arcing time. That is to say, the first and the second aperture can be brought in an open position, i.e. overlapping and thereby providing the through opening, at the time of a current zero event.

The present disclosure further relates to a method of operating a gas-insulated high or medium voltage circuit breaker. In particular, an electric current with a high or medium voltage circuit breaker according to embodiments described herein can be interrupted. Thereby, a circuit breaker can reliably interrupt a current, e.g. a fault current, and a late restrike can be more safely prevented.

The method of operating the gas-insulated high or medium voltage circuit breaker can further include the step of separating the first arcing contact and the second arcing contact by moving at least one of the first and second arcing contact along the switching axis to initiate a breaking operation, and moving, during the breaking operation, at least one of the inner enclosure portion and the outer enclosure portion relatively to each other along the switching axis, such that in the second state of motion the first aperture and the second aperture overlap and provide a through opening for the arc-extinguishing gas to be partially released from the buffer volume to a volume outside of the enclosure.

In some embodiments, the through opening is established at a zero crossing of the current during an arcing time.

Figure 4:
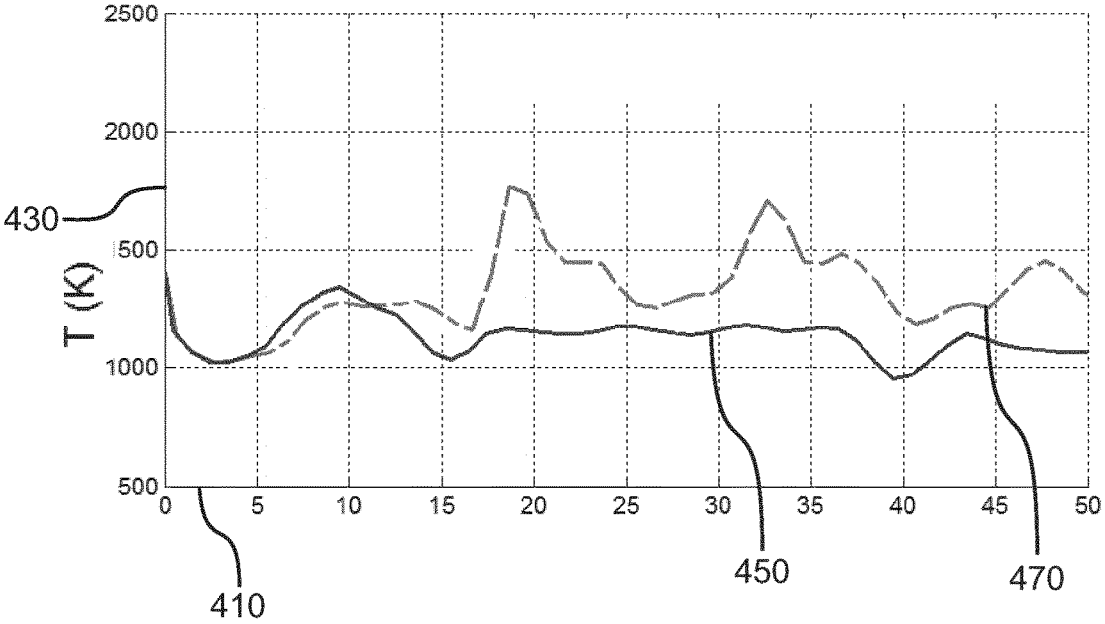
FIG. 4 is a chart comparing the temperature of the gas in the arcing region of a gas-insulated high or medium circuit breaker according to embodiments described herein with the temperature in the arcing region of a conventional circuit breaker.

FIG. 4 is a graph illustrating a result of a computational fluid dynamics simulation for comparing the circuit breaker according to embodiments described herein and a conventional circuit breaker. FIG. 4 shows the averaged gas temperature in units of Kelvin in the arcing region (vertical axis 430) as a function of time. The averaged gas temperature in the arcing region is the temperature in a control volume delimited radially by the nozzle throat and axially by the plug tip and tulip tip. The units of the horizontal axis 410 are given in milliseconds. At time 0 ms at the horizontal axis 410, a current zero event (CZ), such as the interruption of the current, extinguishing of the arc, occurs. Graph 450 (solid line) shows the time course of the temperature of the circuit breaker according to embodiments described herein. Graph 470 (dashed line) shows a conventional circuit breaker. In the conventional circuit breaker, at about 18.7 ms after the CZ, the temperature reaches a peak value. At the peak value of graph 470, the temperature may be already high enough to deteriorate the insulating properties of the arc-extinguishing gas which can lead to an electrical breakdown such that an arc can re-ignite. The temperature increase in graph 470 can be related to a flow reversal of hot gas after the CZ. At about 32.5 ms after CZ, a further peak value in graph 470 is observable.

In contrast, in the circuit breaker according to embodiments described herein (graph 450), the temperature in the arcing zone stays relatively constant after the CZ and no sharp increase is observable. Thus, a significant reduction of the peak values of the averaged arcing region temperature can be achieved. The apertures providing the through opening become active at the CZ of the long arcing time when the gas in the arcing region has reached very high values. The hot gas can then flow into the outer volume of the circuit breaker chamber and the gas that is still in the buffer volume has significant lower temperature. For example, in a puffer type circuit breaker, the through openings are in the open position when the puffer has reached a position corresponding to the current zero of the long arcing time. With the circuit breaker according to the embodiments described herein, the flow reversal of the heated gas to the arcing region can be reduced or can even be eliminated. Thereby, the risk of arc reignition and late re-strikes can be reduced and arc reignition and late re-strikes may even be avoided.

In embodiments of the present disclosure, the circuit breaker can further include a gas blast system configured to apply a gas blast on an arc formed between first arcing contact 101 and the second arcing contact 103 during a stage of a current interruption operation, in the arcing region located in the nozzle 110. The gas blast system may include any suitable structure, configuration, arrangement, and/or components that enable to extinguish an electric arc between the arcing contacts. For example, but not limited to, the gas blast system may include appropriate valves, blast pistons, nozzles, arc heaters, and at least one pressure chamber for the self-blast volume and/or for the compression volume. Further elements from known gas blasts systems with which a person of skill in the art will be familiar can be used with at least some of the embodiments described herein without this being described in more detail here.

The gas-insulated high or medium voltage circuit breaker according to embodiments described herein is preferably adapted to interrupt medium to high-voltages of 12 kV or more, 52 kV or more, more than 72 kV, or 145 kV or more.

According to some embodiments, the gas-insulated high or medium voltage circuit breaker can be one of a puffer-type circuit breaker or a self-blast circuit breaker, or a combination thereof.

In embodiments, the gas blasted by the gas blast system is any suitable gas that enables to adequately extinguish the electric arc formed between the arcing contacts during a current interruption operation, such as, but not limited, to an inert gas as, for example, sulphur hexafluoride $SF_6$. Thereby, the arc between the first and second arcing contacts 101, 103 develops in an arcing region.

For the purposes of this disclosure the fluid used in the circuit breaker can be $SF_6$ gas or any other dielectric insulation medium, may it be gaseous and/or liquid, and in particular can be a dielectric insulation gas or arc quenching gas. Such dielectric insulation medium can for example encompass media comprising an organofluorine compound, such organofluorine compound being selected from the group consisting of: a fluoroether, an oxirane, a fluoroamine, a fluoroketone, a fluoroolefin, a fluoronitrile, and mixtures and/or decomposition products thereof. Herein, the terms "fluoroether", "oxirane", "fluoroamine", "fluoroketone", "fluoroolefin" and "fluoronitrile" refer to at least partially fluorinated compounds. In particular, the term "fluoroether" encompasses both hydrofluoroethers and perfluoroethers, the term "oxirane" encompasses both hydrofluorooxiranes and perfluorooxiranes, the term "fluoroamine" encompasses both hydrofluoroamines and perfluoroamines, the term "fluoroketone" encompasses both hydrofluoroketones and perfluoroketones, the term "fluoroolefin" encompasses both hydrofluoroolefins and perfluoroolefins, and the term "fluoronitrile" encompasses both hydrofluoronitriles and perfluoronitriles. It can thereby be preferred that the fluoroether, the oxirane, the fluoroamine and the fluoroketone are fully fluorinated, i.e. perfluorinated.

In embodiments, the dielectric insulation medium is selected from the group consisting of: a hydrofluoroether, a perfluoroketone, a hydrofluoroolefin, a perfluoronitrile, and mixtures thereof.

In particular, the term "fluoroketone" as used in the context of the present invention shall be interpreted broadly and shall encompass both fluoromonoketones and fluorodiketones or generally fluoropolyketones. Explicitly, more than a single carbonyl group flanked by carbon atoms may be present in the molecule. The term shall also encompass both saturated compounds and unsaturated compounds including double and/or triple bonds between carbon atoms. The at least partially fluorinated alkyl chain of the fluoroketones can be linear or branched and can optionally form a ring.

In embodiments, the dielectric insulation medium comprises at least one compound being a fluoromonoketone and/or comprising also heteroatoms incorporated into the carbon backbone of the molecules, such as at least one of: a nitrogen atom, oxygen atom and sulphur atom, replacing one or more carbon atoms. More preferably, the fluoromonoketone, in particular perfluoroketone, can have from 3 to 15 or from 4 to 12 carbon atoms and particularly from 5 to 9 carbon atoms. Most preferably, it may comprise exactly 5 carbon atoms and/or exactly 6 carbon atoms and/or exactly 7 carbon atoms and/or exactly 8 carbon atoms.

In embodiments, the dielectric insulation medium comprises at least one compound being a fluoroolefin selected from the group consisting of: hydrofluoroolefins (HFO) comprising at least three carbon atoms, hydrofluoroolefins (HFO) comprising exactly three carbon atoms, trans-1,3,3,3-tetrafluoro-1-propene (HFO-1234ze), 2,3,3,3-tetrafluoro-1-propene (HPO-1234yf), and mixtures thereof.

In embodiments, the organofluorine compound can also be a fluoronitrile, in particular a perfluoronitrile. In particular, the organofluorine compound can be a fluoronitrile, specifically a perfluoronitrile, containing two carbon atoms, and/or three carbon atoms, and/or four carbon atoms. More particularly, the fluoronitrile can be a perfluoroalkylnitrile, specifically perfluoroacetonitrile, perfluoropropionitrile (C2F5CN) and/or perfluoro-butyronitrile (C3F7CN). Most particularly, the fluoronitrile can be perfluoroisobutyronitrile (according to the formula (CF3)2CFCN) and/or perfluoro-2-methoxypropanenitrile (according to formula CF3CF(OCF3)CN). Of these, perfluoroisobutyronitrile (i.e. 2,3,3,3-tetrafluoro-2-trifluoromethyl propanenitrile alias i-C3F7CN) is particularly preferred due to its low toxicity.

The dielectric insulation medium can further comprise a background gas or carrier gas different from the organofluorine compound (in particular different from the fluoroether, the oxirane, the fluoroamine, the fluoroketone and the fluoroolefin) and can in embodiments be selected from the group consisting of: air, $N_2$, $O_2$, $CO_2$, a noble gas, $H_2$; $NO_2$, NO, $N_2O$; fluorocarbons and in particular perfluorocarbons, such as $CF_4$; $CF_3I$, $SF_6$; and mixtures thereof. For example, the dielectric insulating gas can be $CO_2$ in an embodiment.

The circuit breaker can comprise also other parts such as nominal contacts, a drive, a controller, and the like, which have been omitted in the Figures and are not described herein in detail. These parts are provided in analogy to a conventional high or medium voltage gas-insulated circuit breaker.

Some embodiments of a circuit breaker and a method of operating a circuit breaker are described above in detail. The apparatus and methods are not limited to the specific embodiments described herein, but rather, components of the circuit breaker and/or steps of the methods may be utilized independently and separately from other components and/or steps described herein, and are not limited to practice with only a circuit breaker as described herein. Rather, the embodiments can be implemented and utilized in connection with many other circuit breaker applications.

Although specific features of various embodiments of the invention may be shown in some drawings and not in others, this is for convenience only. In accordance with the principles of the invention, any feature of a drawing may be referenced and/or claimed in combination with any feature of any other drawing. In particular, the FIGS. 1 to 3 illustrate different aspects which may be combined with other general aspects of the present disclosure. Furthermore, method steps can be implemented as device features, and vice versa device features can be implemented as method steps.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A gas-insulated high or medium voltage circuit breaker comprising:

a first arcing contact and a second arcing contact, wherein at least one of the first and second arcing contacts is axially movable including a first and a second state of motion along a switching axis, wherein during a breaking operation, an arc between the first arcing contact and the second arcing contact is formed in an arcing region;

a nozzle including a channel directed to the arcing region, for blowing an arc-extinguishing gas to the arcing region during the breaking operation;

a diffuser adjacent to the nozzle, for transporting the gas from the arcing region to a region downstream of the diffuser;

a buffer volume directly downstream of the diffuser, and an enclosure substantially surrounding the buffer volume circumferentially, wherein the enclosure comprises:

an inner enclosure portion and a coaxially arranged outer enclosure portion, wherein at least one of the inner enclosure portion and the outer enclosure portion is movable relative to the other one; and a first aperture provided on a surface of the inner enclosure portion and a second aperture provided on a surface of the outer enclosure portion, such that a through opening is provided through the enclosure, wherein in the first state of motion during the breaking operation the through opening corresponding to the first aperture is blocked, as to prevent the gas from being released from the buffer volume to a volume outside of the enclosure; and in the second state of motion, the first aperture and the second aperture overlap one another, such that an overlap of the first aperture and the second aperture provides the through opening for the gas to be partially released from the buffer volume to the volume outside of the enclosure.

2. The gas-insulated high or medium voltage circuit breaker according to claim 1, wherein the inner enclosure portion and the outer enclosure portion of the enclosure are cylindrically shaped.

3. The gas-insulated high or medium voltage circuit breaker-according to claim 1, wherein the inner enclosure portion and the outer enclosure portion of the enclosure are electrically conductive metal pipes.

4. The gas-insulated high or medium voltage circuit breaker according to claim 1, wherein the enclosure is at a same electrical potential as the second arcing contact.

5. The gas-insulated high or medium voltage circuit breaker according to claim 1, wherein at least part of the enclosure is formed as a portion of a nominal current path.

6. The gas-insulated high or medium voltage circuit breaker according to claim 1, further comprising a guiding element adjacent to the second aperture of the outer enclosure portion radially outside to guide the gas that is released in an axial direction away from an axial position of the arcing region.

7. The gas-insulated high or medium voltage circuit breaker according to claim 1, wherein during the breaking operation the through opening in the second state of motion is established at a zero crossing of an electrical current during an arcing time.

8. The gas-insulated high or medium voltage circuit breaker according to claim 1, wherein the first state of motion corresponds to a start of the breaking operation, wherein the first arcing contact and the second arcing contact start to move apart along the switching axis.

9. The gas-insulated high or medium voltage circuit breaker according to claim 1, wherein one of the inner enclosure portion and the outer enclosure portion is stationary and a respective other one is movable together with the second arcing contact.

10. The gas-insulated high or medium voltage circuit breaker according to claim 1, wherein in the second state of motion the overlap of the first aperture and the second aperture is formed at an axial position located along an length axis extending between a front portion of the diffuser and an axial end portion of the second arcing contact.

11. The gas-insulated high or medium voltage circuit breaker according to claim 1, wherein the gas-insulated high or medium circuit breaker is adapted to interrupt medium to high-voltages of 12 kV or more; and/or wherein the gas-insulated high or medium voltage circuit breaker is one of a puffer-type circuit breaker, a self-blast circuit breaker, or a combination thereof.

12. A method of operating the gas-insulated high or medium voltage circuit breaker, the method comprising:

breaking an electric current with the high or medium voltage circuit breaker according to claim 1.

13. The method of operating the gas-insulated high or medium voltage circuit breaker according to claim 12, wherein breaking the electric current comprises:

separating the first arcing contact and the second arcing contact by moving at least one of the first and second arcing contact along the switching axis to initiate the breaking operation; and moving, during the breaking operation, at least one of the inner enclosure portion and the outer enclosure portion relatively to each other along the switching axis, such that in the second state of motion the first aperture and the second aperture overlap and provide the through opening for the arc-extinguishing gas to be partially released from the buffer volume to the volume outside of the enclosure, wherein the through opening is established at a zero crossing of the electrical current during an arcing time.

14. The gas-insulated high or medium voltage circuit breaker according to claim 1, wherein the circuit breaker is the gas-insulated circuit breaker adapted to interrupt medium to high-voltages of 52 kV or more.

15. The gas-insulated high or medium voltage circuit breaker according to claim 1, wherein the circuit breaker is the gas-insulated circuit breaker adapted to interrupt medium to high-voltages of more than 72 kV.

16. The gas-insulated high or medium voltage circuit breaker according to claim 1, wherein the circuit breaker is the gas-insulated circuit breaker adapted to interrupt medium to high-voltages of 145 kV or more.

* * * * *